US008215966B2

(12) United States Patent
Champion et al.

(10) Patent No.: US 8,215,966 B2
(45) Date of Patent: Jul. 10, 2012

(54) INTERPOSER CONNECTOR ASSEMBLY

(75) Inventors: Bruce Allen Champion, Lemoyne, PA (US); Steven Jay Millard, Mechanicsburg, PA (US); Bin Lin, Hummelstown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 175 days.

(21) Appl. No.: 12/763,800

(22) Filed: Apr. 20, 2010

(65) Prior Publication Data

US 2011/0256743 A1 Oct. 20, 2011

(51) Int. Cl.
*H01R 12/00* (2006.01)

(52) U.S. Cl. ..... 439/66

(58) Field of Classification Search ..... 439/66, 439/74; 174/262–266
See application file for complete search history.

(56) References Cited

U.S. PATENT DOCUMENTS 4,322,778 A * 3/1982 Barbour et al. ..... 361/794
6,711,814 B2 * 3/2004 Barr et al. ..... 29/852
6,869,290 B2 3/2005 Brown et al.
6,916,181 B2 7/2005 Brown et al.
6,956,174 B2 * 10/2005 Khandros et al. ..... 174/267
7,021,941 B1 * 4/2006 Chuang et al. ..... 439/66
7,025,061 B2 4/2006 Haussmann
7,025,601 B2 4/2006 Dittmann
D521,455 S 5/2006 Radza
D521,940 S 5/2006 Radza
D522,461 S 6/2006 Radza
D522,972 S 6/2006 Long et al.
7,056,131 B1 6/2006 Williams
524,756 A1 7/2006 Razda
7,070,419 B2 7/2006 Brown et al.
7,090,503 B2 * 8/2006 Dittmann ..... 439/66
7,113,408 B2 9/2006 Brown et al.
7,114,961 B2 10/2006 Williams
7,242,203 B2 * 7/2007 LaMeres et al. ..... 324/750.25
7,244,125 B2 7/2007 Brown et al.
7,347,698 B2 3/2008 Dittmann
7,354,276 B2 4/2008 Dittmann
7,357,644 B2 4/2008 Dittmann
7,371,073 B2 * 5/2008 Williams ..... 439/66
7,383,632 B2 * 6/2008 Dittmann ..... 29/884
7,539,027 B2 * 5/2009 Callahan et al. ..... 361/803
7,597,561 B2 * 10/2009 Radza et al. ..... 439/66
7,621,756 B2 11/2009 Dittmann
7,625,220 B2 12/2009 Dittmann et al.
7,628,617 B2 12/2009 Brown et al.
7,645,147 B2 1/2010 Dittmann
7,785,111 B2 * 8/2010 Hilty et al. ..... 439/66
7,785,113 B2 * 8/2010 Mizoguchi ..... 439/67
7,875,811 B2 * 1/2011 Caletka et al. ..... 174/262
2003/0092293 A1 * 5/2003 Ohtsuki et al. ..... 439/66
2004/0029411 A1 * 2/2004 Rathburn ..... 439/66
2005/0167816 A1 * 8/2005 Khandros et al. ..... 257/692
(Continued)

*Primary Examiner* — Briggitte R Hammond

(57) ABSTRACT

An interposer connector assembly includes a substrate, conductive pads, and contacts. The substrate has opposite first and second sides with a conductive via extending through the substrate. The conductive pads are mounted to the first and second sides of the substrate and electrically coupled with each other by the via. The contacts are electrically joined with the conductive pads on the first and second sides of the substrate. The contacts protrude from the substrate to outer ends that are configured to engage conductive members of electronic packages that mate with the first and second sides of the substrate. A differential electrical impedance characteristic of a conductive pathway extending from the outer end of one of the contacts to the outer end of another one of the contacts is at least 65 Ohms.

20 Claims, 5 Drawing Sheets

U.S. PATENT DOCUMENTS

2006/0189179 A1 8/2006 Dittmann et al.
2006/0208351 A1* 9/2006 Poo et al. ..... 257/693
2006/0232301 A1 10/2006 Morlion et al.
2006/0237223 A1* 10/2006 Chen et al. ..... 174/255
2006/0258183 A1 11/2006 Williams
2007/0269997 A1* 11/2007 Eldridge et al. ..... 439/66
2008/0217050 A1* 9/2008 Egitto et al. ..... 174/262
2011/0256743 A1* 10/2011 Champion et al. ..... 439/74

* cited by examiner

INTERPOSER CONNECTOR ASSEMBLY

BACKGROUND OF THE INVENTION

One or more embodiments of the subject matter described herein relate generally to connectors that electrically couple two or more other connectors or devices, and more specifically, to an interposer connector assembly.

The ongoing trend toward smaller, lighter, and higher performance electrical components and higher density electrical circuits has led to the development of surface mount technology in the design of printed circuit boards and electronic packages. Surface mountable packaging allows for the connection of a package, such as a computer processor, to pads on the surface of the circuit board rather than by contacts or pins soldered in plated holes going through the circuit board. Surface mount technology may allow for an increased component density on a circuit board, thereby saving space on the circuit board.

One form of surface mount technology includes interposer connectors. Interposer connectors may include a dielectric substrate with conductive contacts on both sides of the substrate. Conductive vias, or holes that are lined with a conductive material, extend through the substrate to electrically couple the contacts on opposite sides of the substrate. The contacts on each side of the substrate engage conductive members or terminals of different electronic packages, such as a processor and a circuit board, to electrically couple the electronic packages with each other.

The increasing demand for higher density electrical connections between the interposer connectors and the electronic packages to which the connectors mate has resulted in the contacts, conductive pads, and vias of the interposer connectors being placed relatively close together. Additionally, the differential electrical impedance characteristics of the conductive pathways that extend through the interposer connectors between the contacts are relatively low. As a result, the rate at which the interposer connectors communicate data may be limited. For example, the low differential impedance of the conductive pathways may result in significant noise and interference being induced by one conductive pathway on nearby conductive pathways.

A need exists for an interposer connector that reduces the noise and/or interference between conductive pathways in the connector while permitting relatively high data rates to be communicated through the connector.

BRIEF DESCRIPTION OF THE INVENTION

In one embodiment, an interposer connector assembly is provided. The interposer connector assembly includes a substrate, conductive pads, and contacts. The substrate has opposite first and second sides with a conductive via extending through the substrate. The conductive pads are mounted to the first and second sides of the substrate and electrically coupled with each other by the via. The contacts are electrically joined with the conductive pads on the first and second sides of the substrate. The contacts protrude from the substrate to outer ends that are configured to engage conductive members of electronic packages that mate with the first and second sides of the substrate. A differential electrical impedance characteristic of a conductive pathway extending from the outer end of one of the contacts to the outer end of another one of the contacts is at least 65 Ohms.

In another embodiment, another interposer connector assembly is provided. The interposer connector assembly includes a substrate, conductive pads, and contacts. The substrate has opposite first and second sides with a conductive via extending through the substrate. The conductive pads are mounted to the first and second sides of the substrate and electrically coupled with each other by the via. The contacts are electrically joined with the conductive pads on the first and second sides of the substrate. The contacts protrude from the substrate to outer ends that are configured to engage conductive members of electronic packages that mate with the first and second sides of the substrate. The via of the substrate has an inside diameter dimension of 0.3 millimeters or less.

In another embodiment, another interposer connector assembly is provided. The interposer connector assembly includes a substrate, conductive pads, and contacts. The substrate has opposite first and second sides with a conductive via extending through the substrate. The conductive pads are mounted to the first and second sides of the substrate and electrically coupled with each other by the via. The contacts are electrically joined with the conductive pads on the first and second sides of the substrate. The contacts protrude from the substrate to outer ends that are configured to engage conductive members of electronic packages that mate with the first and second sides of the substrate. The contacts are elongated from fixation ends mounted to the conductive pads to the outer ends. The conductive pads protrude beyond the fixation ends by less than 0.2 millimeters along the first and second sides of the substrate.

DETAILED DESCRIPTION OF THE INVENTION

Figure 1:
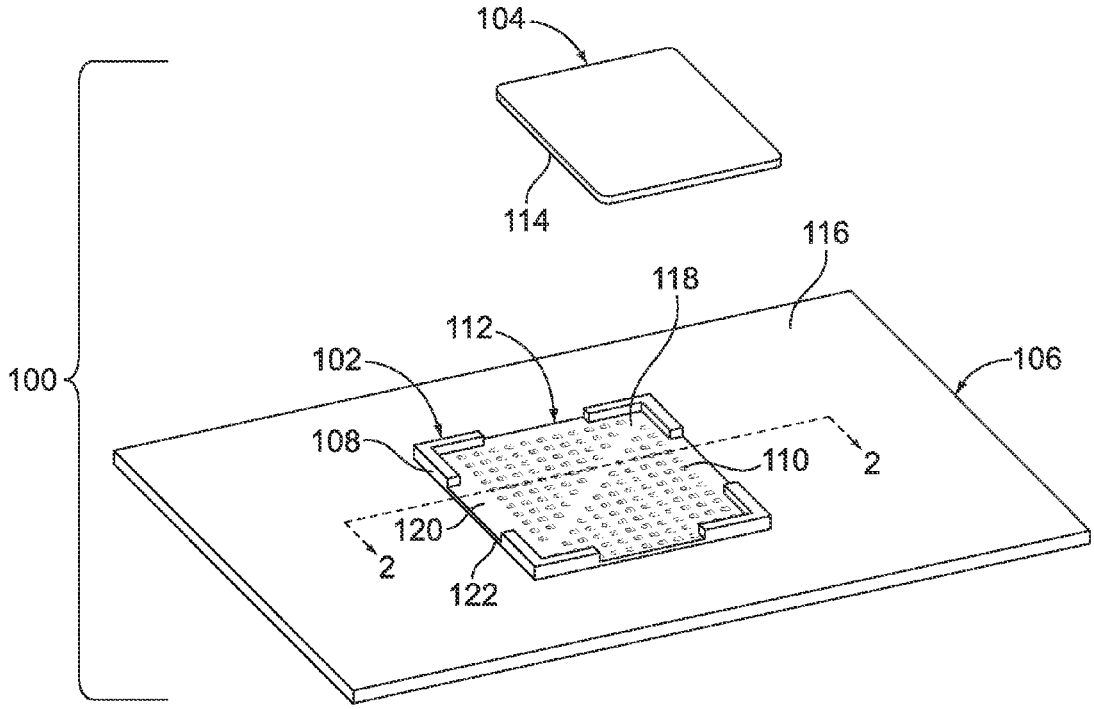
FIG. 1 is a perspective view of an electronic connector system having an interposer connector assembly formed in accordance with one embodiment.

FIG. 1 is a perspective view of an electronic connector system 100 having an interposer connector assembly 102 formed in accordance with one embodiment. The interposer connector assembly 102 mates with and electrically interconnects first and second electronic packages 104, 106. The electronic packages 104, 106 may be circuit boards or electronic devices, such as land grid array (LGA) or ball grid array (BGA) devices. The LGA or BGA devices may be a chip or module, such as, but not limited to, a central processing unit (CPU), microprocessor, or an application specific integrated circuit (ASIC), or the like. The interposer connector assembly 102 may be used to establish board-to-board, board-to-device, and/or device-to-device electrical connections.

In the illustrated embodiment, the interposer connector assembly 102 is a board-to-board interconnect system that electrically joins electronic packages 104, 106, such as circuit boards. The interposer connector assembly 102 may be mounted to the second electronic package 106. A housing 108 is used to position the interposer connector assembly 102 with respect to the first and second electronic packages 104, 106. The housing 108 may completely surround the perimeter of the interposer connector assembly 102, or alternatively, may have separate components provided at predetermined portions of the interposer connector assembly 102, as shown in FIG. 1.

The interposer connector assembly 102 includes a dielectric substrate 118 having opposite sides 120, 122. The substrate 118 may include or be formed from a material having a relatively low dielectric constant. For example, the substrate 118 may be formed from FR-4 material having a dielectric constant of approximately 4.0. Alternatively, the substrate 118 may include or be formed from a material having a lower dielectric constant. By way of example only, the substrate 118 may be formed from Nelco-13SI material having a dielectric constant of approximately 3.2. Using a substrate 118 with a lower dielectric constant may increase a differential electrical impedance characteristic of conductive pathways that extend through the substrate 118. Conductive contacts 110 are coupled to the sides 120, 122 and arranged in a contact array 112 on each side 120, 122. The contacts 110 may be elongated conductive bodies that extend from the sides 120, 122 as cantilevered beams. The first electronic package 104 has a mating surface 114 that includes conductive members 220 (shown in FIG. 2) and the second electronic package 106 has a mating surface 116 that include conductive members 222 (shown in FIG. 2). The conductive members or pads 220, 222 engage the contacts 110 to electrically couple the first and second electronic packages 104, 106 with the interposer connector assembly 102.

Figure 2:
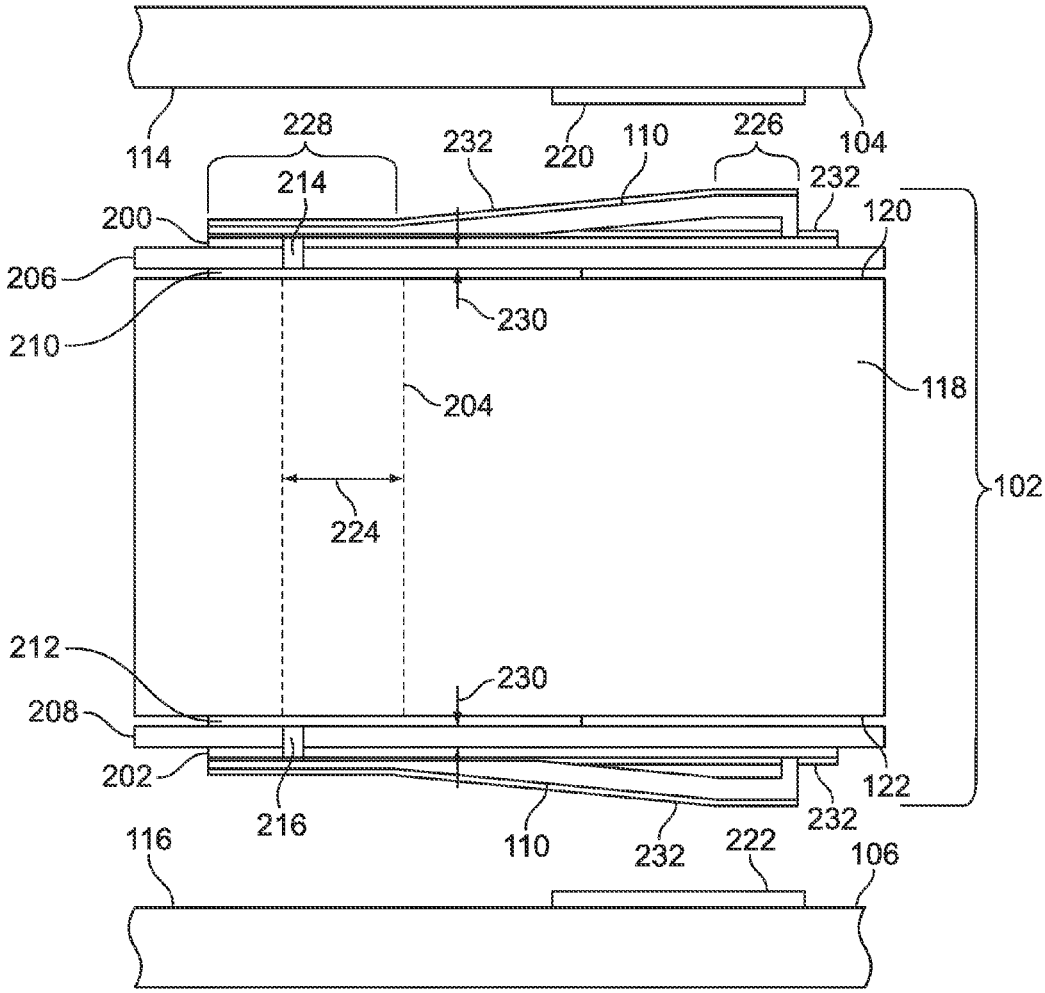
FIG. 2 is a cross-sectional view of the interposer connector assembly shown in FIG. 1 in accordance with one embodiment.

FIG. 2 is a cross-sectional view of the interposer connector assembly 102 along line 2-2 in FIG. 1 in accordance with one embodiment. The substrate 118 includes conductive pads 210, 212 that are mounted to the sides 120, 122. The contacts 110 are joined to the substrate 118 such that the contacts 110 are electrically joined with the conductive pads 210, 212. Conductive vias 204 extend through the substrate 118 from one side 120 to the other side 122. The vias 204 include conductive material that is electrically coupled with the conductive pads 210, 212 such that the contacts 110 on one side 120 of the substrate 118 are electrically connected with the contacts 110 on the opposite side 122 by the conductive pads 210, 212 and the vias 204.

In accordance with one or more embodiments described herein, relative dimensions of and spacing between conductive components, such as the vias 204, conductive pads 210, 212, and the contacts 110 are varied to reduce differential electrical impedance characteristics of the interposer connector assembly 102. For example, the conductive components may be spaced farther apart and the size of the conductive components may be reduced to increase the differential electrical impedance characteristics of conductive pathways that include and extend through coupled pairs of the contacts 110 and conductive pads 210, 212, and the associated vias 204. Increasing the differential electrical impedance characteristics may reduce the noise and/or interference that are induced on one or more conductive pathways by a nearby conductive pathway when relatively high data rates are communicated.

The substrate 118 of the interposer connector assembly 102 includes the conductive pads 210, 212 formed on the opposite sides 120, 122 of the substrate 118. The conductive pads 210, 212 may be metal or metal alloys, such as copper (Cu) or copper alloys, that are deposited on the sides 120, 122 and then selectively etched. In the illustrated embodiment, the vias 204 are electrically joined with the conductive pads 210, 212 so that the vias 204 provide conductive pathways between the conductive pads 210, 212.

Dielectric layers 206, 208 are disposed outside of the conductive pads 210, 212. For example, dielectric layers 206, 208 may be deposited onto the pads 210, 212 such that the conductive pads 210, 212 are located between the dielectric layers 206, 208 and the substrate 118. The dielectric layers 206, 208 may be formed from or include an adhesive that binds a plating mask 200, 202 with the conductive pads 210, 212. The dielectric layers 206, 208 have thickness dimensions 230. The thickness dimension 230 of the dielectric layer 206 may be the same as or different from the thickness dimension 230 of the dielectric layer 208. In accordance with one embodiment, the thickness dimensions 230 of the dielectric layers 206, 208 are increased in size in order to separate the contacts 110 from the conductive pads 210, 212. Increasing the separation between the contacts 110 and the conductive pads 210, 212 may increase a differential electrical impedance characteristic of conductive pathways that extend between contacts 110 on opposite sides 120, 122 of the substrate 118 and that include the conductive pads 210, 212. By way of example only, the thickness dimension 230 may be at least 0.05 millimeters. In another example, the thickness dimension 230 may be at least 0.0508 millimeters. In another embodiment, the thickness dimension 230 may be at least 0.06 millimeters.

The plating mask 200, 202 includes layers that are deposited onto the dielectric layers 206, 208 to protect one or more areas located between the plating mask 200, 202 and the substrate 118 from being removed or etched. For example, the plating mask 200, 202 may include or be formed from a dielectric material, such as a photoresist, that is deposited and then crosslinked to provide a protective layer that prevents the conductive pads 210, 212 from being removed through an etching process.

In the illustrated embodiment, the dielectric layers 206, 208 and the plating masks 200, 202 may be selectively etched so that portions of the dielectric layers 206, 208 are removed and filled or plated with a metal or metal alloy to form conductive interconnects 214, 216. The interconnects 214, 216 may be similar to the vias 204 in that the interconnects 214, 216 provide conductive pathways. The conductive pathways of the interconnects 214, 216 electrically couple the conductive pads 210, 212 with the contacts 110.

The contacts 110 are mounted to the plating masks 200, 202 such that the contacts 110 are electrically coupled with the interconnects 214, 216. Alternatively, the contacts 110 may be mounted to the conductive pads 210, 212. The contacts 110 are elongated between fixation ends 228 and outer ends 226. The fixation ends 228 may be coupled to the plating masks 200, 202 and the outer ends 226 may be free ends which are configured for engagement with the conductive pads 210, 212. For example, the contacts 110 may be joined to the plating masks 200, 202 as cantilevered beams.

In one embodiment, after the contacts 110 are mounted to the plating masks 200, 202, a conductive plating layer 232 is deposited onto the contacts 110 and the plating masks 200, 202. For example, a metal or metal alloy may be deposited onto the contacts 110 and the plating masks 200, 202. The plating layer 232 may be deposited onto the dielectric layers 206, 208 but removed by an etching process. A differential electrical impedance characteristic of a conductive pathway that extends between the contacts 110 on opposite sides 120, 122 of the substrate 118 and that includes the plating layers 232 and the contacts 110 may be related to the size of the plating layers 232. For example, reducing the size and/or thickness of the plating layers 232 deposited onto the plating masks 200, 202 may increase the differential electrical impedance characteristic of the conductive pathway. As described below, the size of the plating layers 232 is reduced in one embodiment by decreasing the size of the plating masks 200, 202 relative to the contacts 110.

In operation, the outer ends 226 are engaged by conductive members 220, 222 of the first and second electronic packages 104, 106 when the first and second electronic packages 104, 106 mate with the opposite sides 120, 122 of the interposer connector assembly 102. The conductive members 220, 222 may be conductive pads and/or traces of the electronic packages 104, 106.

The conductive members 220, 222 are electrically joined with each other by the interposer connector assembly 102. For example, the interposer connector assembly 102 provides a conductive pathway that couples the conductive members 220, 222. The conductive pathway includes the contacts 110, the conductive pads 210, 212, the interconnects 214, 216, the conductive plating layers 232, and the via 204 in the illustrated embodiment. Alternatively, the conductive pathway may include different components and/or a different number of components. For example, the conductive pads 210, 212 may be coupled with the via 204 and/or the contacts 110 may be mounted to the conductive pads 210, 212 without using the interconnects 214, 216 to electrically couple the contacts 110 with each other.

The via 204 has an inside diameter dimension 224 within the substrate 118. For example, the via 204 may have the inside diameter dimension 224 that defines the width of the via 204 within the thickness of the substrate 118. The inside diameter dimension 224 may establish the thickness of the conductive material in the via 204 through the thickness of the substrate 118. In one embodiment, the inside diameter dimension 224 is reduced to increase a differential electrical impedance characteristic of a conductive pathway that extends through the interposer connector assembly 102 and includes the contacts 110, the conductive pads 210, the interconnects 214, 216, the conductive plating layers 232 and the via 204. By way of example only, the inside diameter dimension 224 may be smaller than 16 mils, or 0.4 millimeters. In another example, the inside diameter dimension 224 may be 12 mils, or 0.3 millimeters, or less.

Figure 3:
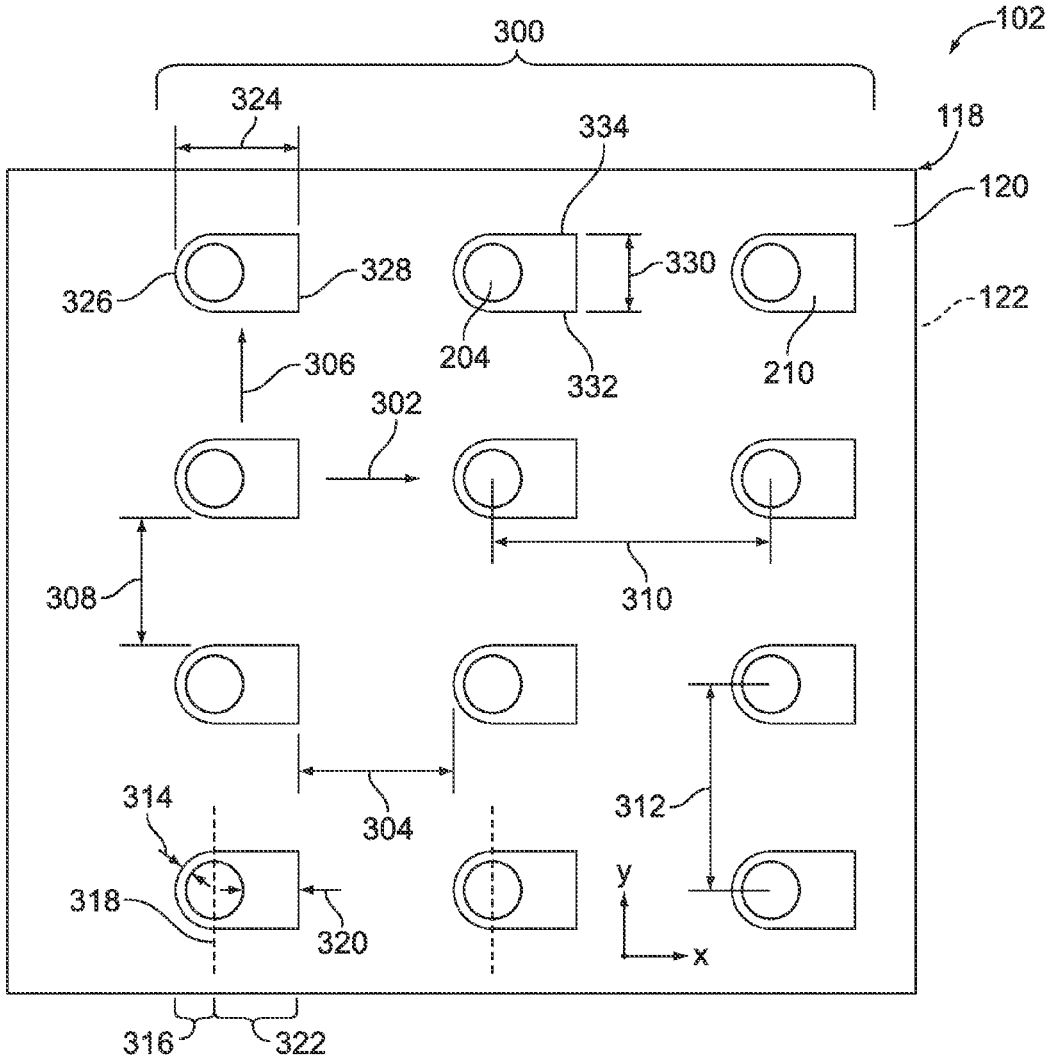
FIG. 3 is a top view of a substrate of the interposer connector assembly shown in FIG. 1 in accordance with one embodiment.

FIG. 3 is a top view of the substrate 118 of the interposer connector assembly 102 in accordance with one embodiment. The view shown in FIG. 3 illustrates the side 120 of the substrate 118, but the discussion herein may also apply to the side 122 of the substrate 118. The conductive pads 210 are arranged in an array 300 on the side 120 of the substrate 118. For example, the conductive pads 210 may be disposed in a regular grid or pattern that defines the array 300.

The conductive pads 210 are elongated along longitudinal directions 302 that are oriented along or parallel to the side 120 of the substrate 118. The conductive pads 210 have length dimensions 324 that are measured between opposite ends 326, 328 of the conductive pads 210 along the longitudinal directions 302. The conductive pads 210 have width dimensions 330 that are measured between opposite sides 332, 334 of the conductive pads 210 along lateral directions 306 that are oriented perpendicular to the longitudinal directions 302.

Conductive pads 210 that are adjacent or neighbor each other along the longitudinal directions 302 are separated from each other by a first separation dimension 304. Conductive pads 210 that are adjacent or neighbor each other along the lateral directions 306 are separated by a second separation dimension 308. As shown in FIG. 3, the longitudinal and lateral directions 302, 306 are oriented perpendicular to each other. The first and second separation dimensions 304, 308 may differ from each other or be approximately the same. In one embodiment, the size of the first and/or second separation dimensions 304, 308 may be increased to reduce coupling between adjacent conductive pads 210. Increasing the separation between the conductive pads 210 may increase the differential electrical impedance characteristic of the conductive pathways that extend through the interposer connector assembly 102 and that each include the via 204, the conductive pads 210, 212 (shown in FIG. 2), and the contacts 110 (shown in FIG. 1). By way of example only, the first and second separation dimensions 304, 308 may be at least 0.5 millimeters or 20 mils. In another example, the first separation dimension 304 may be at least 0.5 millimeters while the second separation dimension 308 may be at least 0.8 millimeters. The increased separation dimensions 304, 308 of the conductive pads 210 may increase the differential electrical impedance characteristic relative to other interposer connector assemblies that have conductive pads 210 spaced closer together.

The vias 204 associated with the conductive pads 210 are separated from each other in the array 300 by first and second pitch dimensions 310, 312 along the longitudinal and lateral directions 302, 306. The pitch dimensions 310, 312 may differ or be approximately the same. One or more of the pitch dimensions 310, 312 may be increased to increase a differential electrical impedance characteristic of the conductive pathways that extend through the vias 204 and include the contacts 110 (shown in FIG. 1) and the conductive pads 210, 212 (shown in FIG. 2). By way of example only, one or more of the pitch dimensions 310, 312 may be increased to a distance that is greater than 1.0 millimeter. In one embodiment, the pitch dimensions 310, 312 are at least 1.2, 1.4, or 1.9 millimeters. For example, the pitch dimensions 310 along the longitudinal directions 302 may be at least 1.9 millimeters and the pitch dimensions 312 along the lateral directions 306 may be at least 1.4 millimeters.

Increasing one or more of the separation and/or pitch dimensions 304, 308, 310, 312 may reduce the pin count of the interposer connector assembly 102, or the number of conductive pathways extending through the interposer connector assembly 102 between contacts 110 (shown in FIG. 1) on opposite sides 120, 122 (shown in FIG. 1) of the substrate 118. But, increasing the separation and/or pitch dimensions 304, 308, 310, 312 also may reduce electric coupling between adjacent conductive pads 210, 212 and/or vias 204. Increasing the separation and/or pitch dimensions 304, 308, 310, 312 may increase the differential electrical impedance characteristics of the conductive pathways. Increasing the differential electrical impedance characteristic of the conductive pathways may allow for the interposer connector assembly 102 to communicate higher data rate signals between the electronic packages 104, 106.

As shown in FIG. 3, the conductive pads 210 encircle the peripheries of the vias 204. Alternatively, the conductive pads 210 may extend around less than all of the peripheries of the vias 204. For example, the conductive pads 210 may partially extend around the vias 204. The conductive pads 210 have a border dimension 314 that defines a distance that the conductive pads 210 outwardly extend from the vias 204 along the side 120 of the substrate 118. For example, the border dimension 314 may be a distance that the conductive pads 210 radially extend away from the vias 204. In the illustrated embodiment, the border dimension 314 may be larger in some radial directions than others. For example, the border dimension 314 on one side 316 of a bisecting plane 318 that extends through the center of the via 204 may be smaller than a border dimension 320 on the opposite side 322 of the plane 318. In the illustrated embodiment, the border dimensions 314 are smaller than the border dimensions 320.

One or more of the border dimensions 314, 320 may be reduced in size to increase a differential electrical impedance characteristic of the conductive pathway that extends through the conductive pads 210, 212 (shown in FIG. 2) and the via 204. For example, as the amount of conductive material forming the conductive pads 210, 212 is decreased, the differential electrical impedance characteristic of the conductive pads 210, 212 may increase. By way of example only, the border dimension 314 may be 5 mils, or 0.1 millimeters, or smaller. In another example, the border dimension 314 may be 3 mils, or 0.08 millimeters, or smaller. In another embodiment, the border dimension 314 may be 1 mil, or 0.03 millimeters, or smaller.

Figure 4:
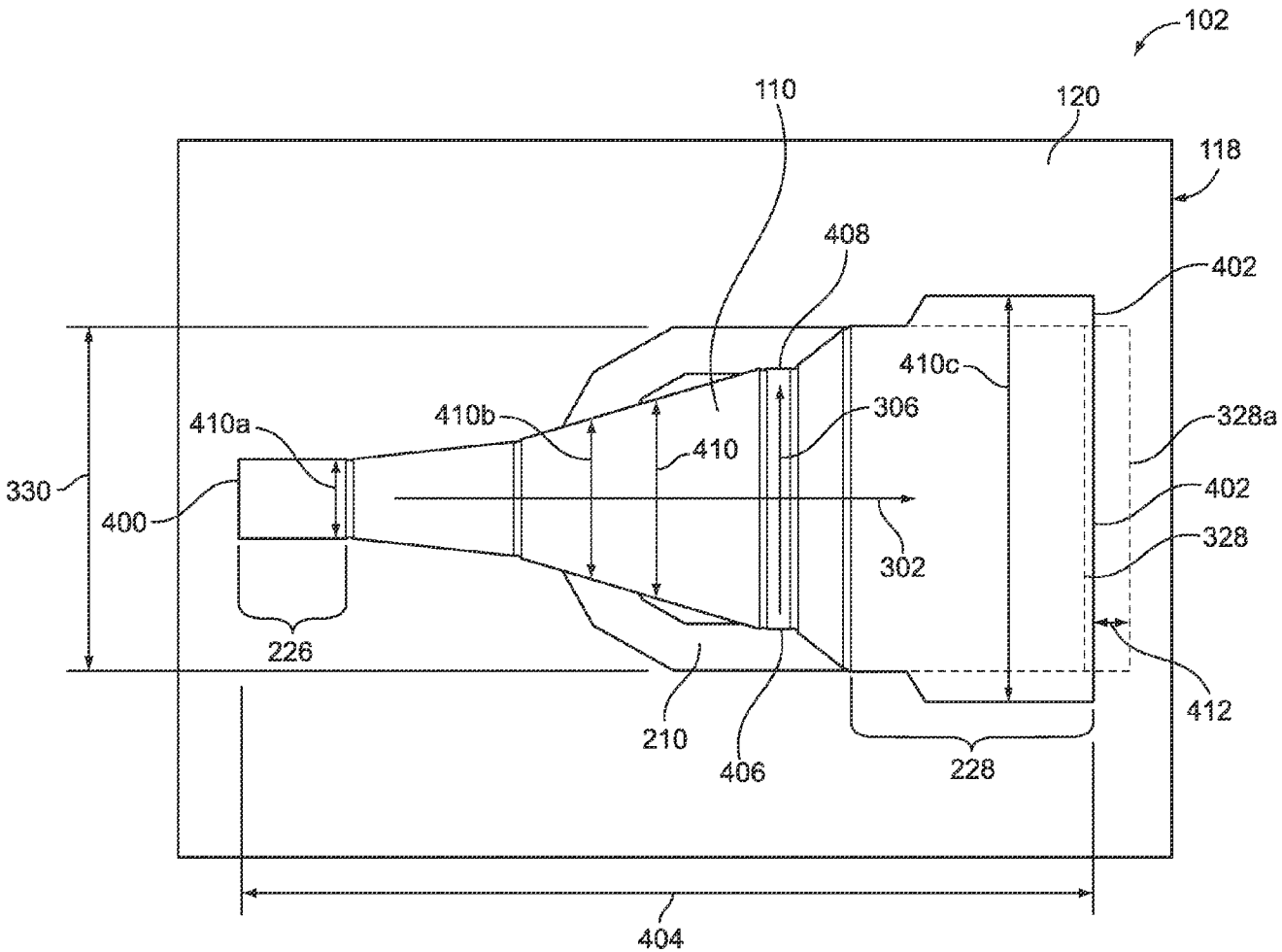
FIG. 4 is a top view of the interposer connector assembly shown in FIG. 1 with the plating mask shown in FIG. 2 removed in accordance with one embodiment.

FIG. 4 is a top view of the interposer connector assembly 102 with the plating mask 200 (shown in FIG. 2) removed in accordance with one embodiment. While the discussion herein focuses on the side 120 of the substrate 118 and the contacts 110 and conductive pads 210 joined to the side 120, the discussion also may apply to the side 122 (shown in FIG. 1) of the substrate 118 and the contacts 110 and conductive pads 212 (shown in FIG. 2) on the side 122. As shown in FIG. 4, the contacts 110 are elongated bodies that extend from the fixation ends 228 to the outer ends 226. The contacts 110 are elongated in directions that are parallel to the longitudinal directions 302.

The contact 110 may extend from one edge 400 to an opposite edge 402 along the longitudinal direction 302. The contact 110 has a length dimension 404 that is measured between the edges 400, 402 along the longitudinal direction 302. The contact 110 extends between opposite sides 406, 408 along the lateral direction 306. The contact 110 may have several different width dimensions 410 that are measured between the sides 406, 408 along the lateral direction 306. For example, as shown in FIG. 4, the contact 110 may have different width dimensions 410 at different locations along the length of the contact 110. Several examples of the different width dimensions 410 are labeled as 410*a*, 410*b*, and 410*c* in the illustrated embodiment.

The width dimension 330 of the conductive pad 210 to which the contact 110 is electrically coupled is no larger than the width dimension 410 of the contact 110 in one embodiment. For example, the width dimension 330 of the conductive pad 210 may be smaller than the width dimension 410*c* of the contact 110 in the fixation end 228 of the contact 110. In another example, the width dimension 330 of the conductive pad 210 may be no larger than the largest width dimension 410 of the contact 110. Alternatively, the width dimension 330 may slightly exceed the width dimension 410 of the contact 110. For example, the width dimension 330 of the conductive pad 210 may be 110% or less of the width dimension 410 of the contact 110. In another example, the width dimension 330 may be no more than 108% or 105% of the width dimension 410. Reducing the size of the conductive pad 210 relative to the size of the contact 110 may increase a differential electrical impedance characteristic of the conductive pathway that includes the contact 110 and the conductive pad 210. For example, reducing the width dimension 330 of the conductive pad 210 relative to the width dimension 410 of the contact 110 may increase the differential electrical impedance characteristic of the conductive pathway that electrically couples the contacts 110 on the opposite sides 120, 122 (shown in FIG. 1) of the interposer connector assembly 102.

In the illustrated embodiment, the conductive pad 210 is formed on the substrate 118 such that the end 328 of the conductive pad 210 does not extend beyond the edge 402 of the contact 110. For example, the end 328 of the conductive pad 210 may be approximately coextensive with the edge 402 of the contact 110 such that the end 328 is not visible in the view shown in FIG. 4. Alternatively, the end 328 of the conductive pad 210 may protrude beyond the edge 402 of the contact 110. For example, the end 328 may extend to a position shown and labeled as 328*a* in FIG. 4. The distance that the end 328*a* protrudes beyond the edge 402 of the contact 110 is limited in accordance with one embodiment. By way of example only, a protruding dimension 412 may be defined as the distance that the end 328*a* of the conductive pad 210 protrudes beyond the edge 402 of the contact 110 along the longitudinal direction 302. The protruding dimension 412 is limited to 0.3 millimeters or less in one embodiment. Alternatively, the protruding dimension 412 may be 0.2 millimeters or less, or 0.15 millimeters or less in other embodiments.

Figure 5:
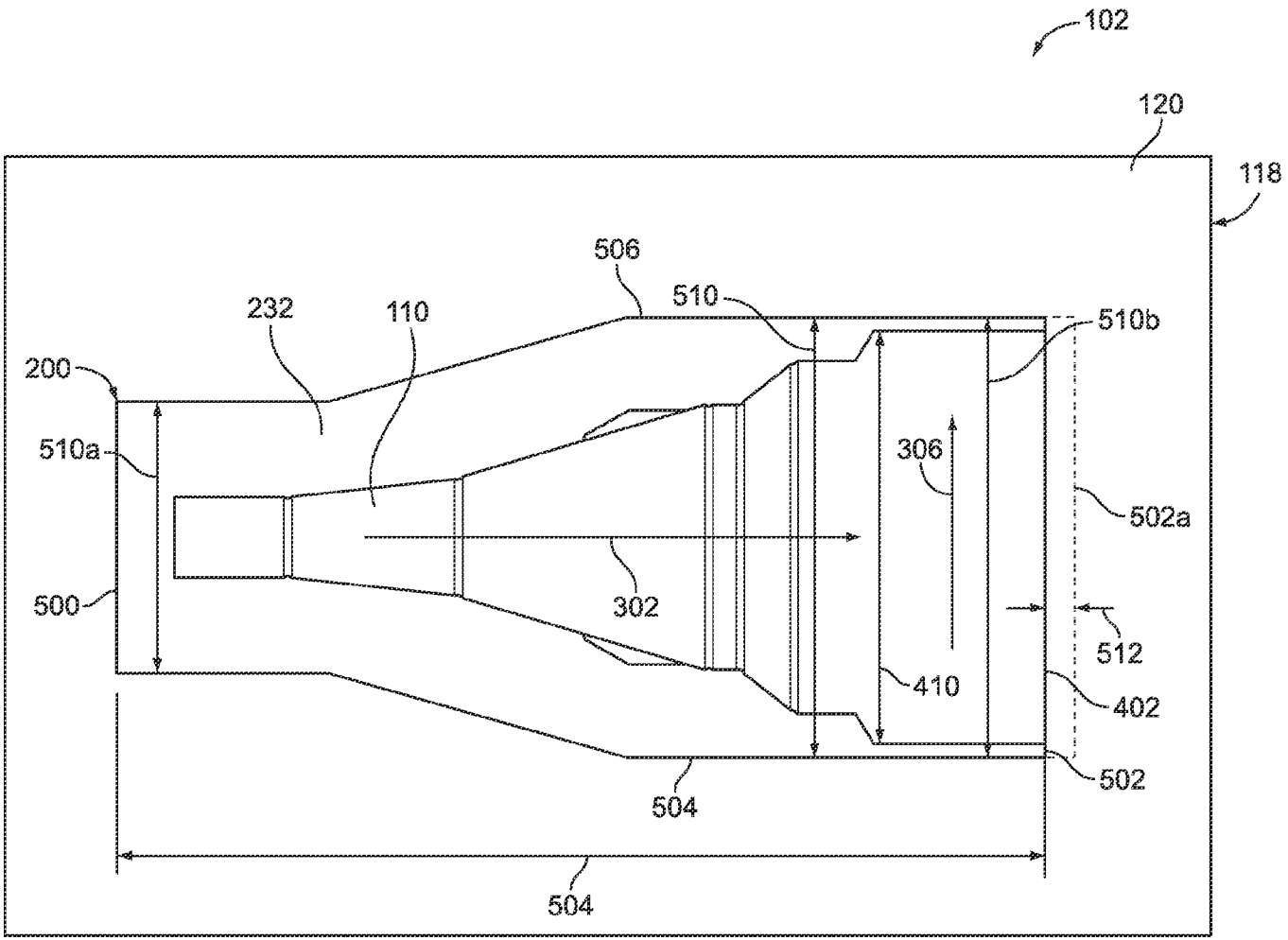
FIG. 5 is a top view of the interposer connector assembly in accordance with one embodiment.

FIG. 5 is a top view of the interposer connector assembly 102 in accordance with one embodiment. The discussion below focuses on the side 120 of the substrate 118 and on the plating mask 200, but may equally apply to the side 122 (shown in FIG. 1) and the plating mask 202 (shown in FIG. 2). The plating mask 200 is elongated between a front edge 500 and a back edge 502 along the longitudinal direction 302. The plating mask 200 also extends from a side edge 504 to an opposite side edge 506 along the lateral direction 306. The plating mask 200 has a length dimension 508 that is measured between the front and back edges 500, 502 and a width dimension 510 that is measured between the side edges 504, 506. As shown in FIG. 5, the width dimension 510 may be different at different locations along the length of the plating mask 200. For example, a width dimension 510*a* that is measured near the front edge 500 may be smaller than a width dimension 510*b* measured at or near the back edge 502.

As described above, the size of the plating mask 200 may be reduced to increase a differential electrical impedance characteristic of the conductive pathway that extends between the contacts 110 on the opposite sides 120, 122 (shown in FIG. 1) of the substrate 118 and the plating layers 232 (shown in FIG. 2) deposited on the plating mask 200. In accordance with one embodiment, the width dimension 510 of the plating mask 200 may be reduced relative to the width dimension 410 of the contact 110. For example, the width dimension 510 of the plating mask 200 at or near the back edge 502 may be 110% or less than the width dimension 410 of the contact 110 at or near the edge 402 of the contact 110. In another example, the width dimension 510 may be 108% or 105% or less than the width dimension 410. Alternatively, the width dimension 510 may be no larger than the width dimension 410.

In the illustrated embodiment, the plating mask 200 is formed on the substrate 118 such that the back edge 502 of the plating mask 200 does not extend beyond the edge 402 of the contact 110. For example, the back edge 502 may be approximately coextensive with the edge 402 such that the back edge 502 is not visible in the view shown in FIG. 5. Alternatively, the back edge 502 of the plating mask 200 may protrude beyond the edge 402 of the contact 110. For example, the back edge 502 may extend to a position shown and labeled as 502*a*. The distance that the back edge 502*a* protrudes beyond the edge 402 of the contact 110 is reduced in accordance with one embodiment. By way of example only, a protruding dimension 512 may be defined as the distance that the back edge 502 of the plating mask 200 protrudes beyond the edge 402 of the contact 110 along the longitudinal direction 302. The protruding dimension 512 is limited to 0.3 millimeters or less in one embodiment. Alternatively, the protruding dimension 512 may be 0.2 millimeters or less, or 0.15 millimeters or less in other embodiments.

As described above, the dimensions and/or relative sizes of one or more conductive components of the interposer connector assembly 102 may be reduced in size and/or the relative positions of the components may be moved. Changing the relative positions and/or reducing the dimensions and/or sizes of the conductive components can increase differential electrical impedance characteristics of the conductive pathways that extend through the interposer connector assembly 102. For example, the differential electrical impedance characteristic of a conductive pathway that includes contacts 110 on opposite sides 120, 122 of the substrate 118, conductive pads 210, 212, the interconnects 214, 216, plating layers 232 on the plating masks 200, 202, and the via 204 may be at least 65 Ohms. In another example, the differential electrical impedance characteristic may be at least 80, 85, or 90 Ohms. These conductive pathways may be the conductive pathways that carry high speed data signals through the interposer connector assembly 102. By increasing the differential electrical impedance characteristics of the conductive pathways, high data rates may be used to communicate data through the interposer connector assembly 102.

Dimensions, types of materials, orientations of the various components, and the number and positions of the various components described herein are intended to define parameters of certain embodiments, and are by no means limiting and are merely example embodiments. Many other embodiments and modifications within the spirit and scope of the claims will be apparent to those of skill in the art upon reviewing the above description. The scope of the subject matter described herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. An interposer connector assembly comprising:

a substrate having opposite first and second sides with a conductive via extending through the substrate;

conductive pads mounted to the first and second sides of the substrate and electrically coupled with each other by the via;

contacts electrically joined with the conductive pads on the first and second sides of the substrate, the contacts protruding from the substrate to outer ends that are configured to engage conductive members of electronic packages that mate with the first and second sides of the substrate, wherein a differential electrical impedance characteristic of a conductive pathway extending from the outer end of one of the contacts to the outer end of another one of the contacts is at least 65 Ohms; and dielectric layers disposed between the contacts and the conductive pads and conductive plating layers deposited on the dielectric layers.

2. The interposer connector assembly of claim 1, wherein the via of the substrate has an inside diameter dimension of 0.3 millimeters or less.

3. The interposer connector assembly of claim 1, wherein the contacts are elongated from fixation ends mounted to the dielectric layers to the outer ends, the dielectric layers and plating layers protruding beyond the fixation ends by less than 0.2 millimeters along the first and second sides of the substrate.

4. The interposer connector assembly of claim 1, wherein the dielectric layers and the plating layers have a width dimension that is 110% or less of a width dimension of the contacts along a common direction.

5. The interposer connector assembly of claim 1, wherein the conductive pads at least partially extend around peripheries of the via on the first and second sides of the substrate by a border dimension, the border dimension being less than 0.1 millimeters.

6. The interposer connector assembly of claim 1, wherein the substrate includes a plurality of the vias and a plurality of pairs of the conductive pads with each of the pairs of conductive pads coupled with a different one of the vias, the conductive pads separated from each other on the first and second sides of the substrate along a longitudinal and lateral directions by separation dimensions of at least 0.5 millimeters.

7. The interposer connector assembly of claim 6, wherein the separation dimension between adjacent conductive pads on each of the first and second sides of the substrate along the longitudinal direction is greater than the separation dimension along the lateral direction.

8. An interposer connector assembly comprising:

a substrate having opposite first and second sides with a conductive via extending through the substrate;

conductive pads mounted to the first and second sides of the substrate and electrically coupled with each other by the via;

contacts electrically joined with the conductive pads on the first and second sides of the substrate, the contacts protruding from the substrate to outer ends that are configured to engage conductive members of electronic packages that mate with the first and second sides of the substrate, wherein the via of the substrate has an inside diameter dimension of 0.3 millimeters or less; and dielectric layers disposed between the contacts and the conductive pads and conductive plating layers deposited on the dielectric layers.

9. The interposer connector assembly of claim 8, wherein a differential electrical impedance characteristic of a conductive pathway extending from the outer end of one of the contacts to the outer end of another one of the contacts is at least 65 Ohms.

10. The interposer connector assembly of claim 8, wherein the conductive pads at least partially extend around peripheries of the via on the first and second sides of the substrate by a border dimension, the border dimension being less than 0.1 millimeters.

11. The interposer connector assembly of claim 8, wherein the contacts are elongated from fixation ends mounted to the dielectric layers to the outer ends, the dielectric layers and plating layers protruding beyond the fixation ends by less than 0.2 millimeters along the first and second sides of the substrate.

12. The interposer connector assembly of claim 8, wherein the dielectric layers and the plating layers have a width dimension that is 110% or less of a width dimension of the contacts along a common direction.

13. The interposer connector assembly of claim 8, wherein the substrate includes a plurality of the vias and a plurality of pairs of the conductive pads with each of the pairs of conductive pads coupled with a different one of the vias, the conductive pads separated from each other on the first and second sides of the substrate along a longitudinal and lateral directions by separation dimensions of at least 0.5 millimeters.

14. The interposer connector assembly of claim 13, wherein the separation dimension between adjacent conductive pads on each of the first and second sides of the substrate along the longitudinal direction is greater than the separation dimension along the lateral direction.

15. An interposer connector assembly comprising:

a substrate having opposite first and second sides with a conductive via extending through the substrate;

conductive pads mounted to the first and second sides of the substrate and electrically coupled with each other by the via;

contacts electrically joined with the conductive pads on the first and second sides of the substrate, the contacts protruding from the substrate to outer ends that are configured to engage conductive members of electronic packages that mate with the first and second sides of the substrate, wherein the contacts are elongated from fixation ends mounted to the conductive pads to the outer ends, the conductive pads protruding beyond the fixation ends by less than 0.2 millimeters along the first and second sides of the substrate; and dielectric layers disposed between the contacts and the conductive pads and conductive plating layers deposited on the dielectric layers.

16. The interposer connector assembly of claim 15, wherein a differential electrical impedance characteristic of a conductive pathway extending from the outer end of one of the contacts to the outer end of another one of the contacts is at least 65 Ohms.

17. The interposer connector assembly of claim 15, wherein the substrate includes a material having a dielectric constant of less than 4.0.

18. An interposer connector assembly comprising:

a substrate having opposite first and second sides with a conductive via extending through the substrate;

conductive pads mounted to the first and second sides of the substrate and electrically coupled with each other by the via;

contacts electrically joined with the conductive pads on the first and second sides of the substrate, the contacts protruding from the substrate to outer ends that are configured to engage conductive members of electronic packages that mate with the first and second sides of the substrate; and dielectric layers disposed between the contacts and the conductive pads and conductive plating layers deposited on the dielectric layers.

19. The interposer connector assembly of claim 15, wherein the substrate includes a plurality of the vias and a plurality of pairs of the conductive pads with each of the pairs of conductive pads coupled with a different one of the vias, the conductive pads separated from each other on the first and second sides of the substrate along a longitudinal and lateral directions by separation dimensions of at least 0.5 millimeters.

20. The interposer connector assembly of claim 19, wherein the separation dimension between adjacent conductive pads on each of the first and second sides of the substrate along the longitudinal direction is greater than the separation dimension along the lateral direction.

* * * * *